US006739251B2

(12) United States Patent
Gaffney et al.

(10) Patent No.: US 6,739,251 B2
(45) **Date of Patent: *May 25, 2004**

(54) OFFSET LITHOGRAPHIC PRINTING PRESS

(75) Inventors: John Marshall Gaffney, Kittery Point, ME (US); Glenn Alan Guaraldi, Kingston, NH (US); James Brian Vrotacoe, Rochester, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/087,702

(22) Filed: Feb. 28, 2002

(65) Prior Publication Data

US 2002/0078840 A1 Jun. 27, 2002

Related U.S. Application Data

(63) Continuation of application No. 08/967,496, filed on Nov. 11, 1997, now Pat. No. 6,374,734, which is a continuation of application No. 08/791,669, filed on Jan. 30, 1997, now abandoned, which is a continuation of application No. 08/575,805, filed on Dec. 22, 1995, now abandoned, which is a continuation of application No. 08/474,436, filed on Jun. 7, 1995, now abandoned, which is a continuation of application No. 08/210,633, filed on Mar. 18, 1994, now Pat. No. 5,429,048, which is a continuation of application No. 07/864,680, filed on Apr. 7, 1992, now abandoned, which is a continuation-in-part of application No. 07/699,668, filed on May 14, 1991, now abandoned, which is a continuation-in-part of application No. 07/417,587, filed on Oct. 5, 1989, now abandoned, said application No. 08/474,436, is a continuation-in-part of application No. 08/430,710, filed on Apr. 27, 1995, now abandoned, which is a continuation of application No. 07/962,152, filed on Oct. 16, 1992, now abandoned, which is a continuation of application No. 07/417,587, filed on Oct. 5, 1989, now abandoned.

(51) Int. Cl.[7] ..... B41F 7/02; B41N 10/00

(52) U.S. Cl. ..... 101/217; 101/376

(58) Field of Search ..... 101/141, 142, 101/216, 217, 218, 375, 376; 428/909

(56) References Cited

U.S. PATENT DOCUMENTS

| | | | | | |
|---|---|---|---|---|---|
| 3,166,013 | A | * | 1/1965 | Wyllie et al. | 101/378 |
| 4,458,591 | A | * | 7/1984 | Guaraldi | 101/247 |
| 4,807,527 | A | * | 2/1989 | Knauer | 101/216 |
| 4,823,697 | A | * | 4/1989 | Randazzo | 101/375 |
| 4,913,048 | A | * | 4/1990 | Tittgemeyer | 101/141 |
| 4,953,461 | A | * | 9/1990 | Gaffney et al. | 101/142 |
| 5,109,240 | A | * | 4/1992 | Engl et al. | 347/111 |
| 5,123,343 | A | * | 6/1992 | Willer | 101/23 |
| 5,429,048 | A | * | 7/1995 | Gaffney et al. | 101/217 |
| 5,440,981 | A | * | 8/1995 | Vrotacoe et al. | 101/217 |
| 6,386,100 | B1 | * | 5/2002 | Gaffney et al. | 101/142 |

FOREIGN PATENT DOCUMENTS

| | | |
|---|---|---|
| CA | 2026954 | 4/1991 |

* cited by examiner

*Primary Examiner*—Stephen R. Funk
(74) *Attorney, Agent, or Firm*—Kenyon & Kenyon

(57) ABSTRACT

An improved printing press includes a tubular-shaped printing blanket removably disposed on a blanket cylinder rotatably supported by a frame and having an outer circumferential surface. The printing blanket is disposed in rolling engagement with a conventional printing plate disposed on a plate cylinder having an axially extending gap in which opposite ends of the printing plate are secured. The printing blanket is removed by opening a portion of the frame and axially sliding the printing blanket off of the blanket cylinder. The blanket cylinder has passages which deliver a stream of air to the outer surface of the blanket cylinder which expands the inner circumferential surface of the printing blanket so that the blanket can be axially removed or inserted onto the blanket cylinder. The printing blanket has a metal inner surface which is tensioned by the blanket cylinder to retain the printing blanket on the blanket cylinder during operation of the press. The printing blanket is at least partially formed of a compressible material.

8 Claims, 10 Drawing Sheets

OFFSET LITHOGRAPHIC PRINTING PRESS

CROSS REFERENCE TO RELATED APPLICATIONS

This application is a continuation of application Ser. No. 08/967,496, filed Nov. 11, 1997, now U.S. Pat. No. 6,374,734, which is a continuation of application Ser. No. 08/791,669, filed Jan. 30, 1997, now abandoned, which is a continuation of application Ser. No. 08/575,805, filed Dec. 22, 1995, now abandoned, which is a continuation of application Ser. No. 08/474,436, filed Jun. 7, 1995, now abandoned, which is a continuation of application Ser. No. 08/210,633, filed Mar. 18, 1994, now U.S. Pat. No. 5,429,048, which is a continuation of application Ser. No. 07/864,680, filed Apr. 7, 1992, now abandoned, which is a continuation-in-part of application Ser. No. 07/699,668, filed May 14, 1991, now abandoned, which is a continuation-in-part of application Ser. No. 07/417,587, filed Oct. 5, 1989, now abandoned. Application Ser. No. 08/474,436 is also a continuation-in-part of application Ser. No. 08/430,710, filed Apr. 27, 1995, now abandoned, which is a continuation of application Ser. No. 07/962,152, filed Oct. 16, 1992, now abandoned, which is a continuation of application Ser. No. 07/417,587, filed Oct. 5, 1989, now abandoned.

FIELD OF THE INVENTION

The present invention relates to an offset lithographic printing press. In particular, it relates to gapless tubular printing blankets.

BACKGROUND INFORMATION

Conventional offset printing presses typically include a plate cylinder, a blanket cylinder and an impression cylinder supported for rotation in the press. The plate cylinder carries a printing plate having a rigid surface defining an image to be printed. The blanket cylinder carries a printing blanket having a flexible surface which contacts the printing plate at a nip between the plate cylinder and the blanket cylinder. A web or sheet material to be printed moves through a nip between the blanket cylinder and the impression cylinder. Ink is applied to the surface of the printing plate on the plate cylinder. An inked image is picked up by the printing blanket at the nip between the blanket cylinder and the plate cylinder, and is transferred from the printing blanket to the web or sheet at the nip between the blanket cylinder and the impression cylinder. The impression cylinder can be another blanket cylinder for printing on the opposite side of the web or sheet material or simply a support cylinder when printing is desired only on one side of the web or sheet.

Conventional printing blankets are manufactured as a flat sheet. Such a printing blanket is mounted on a blanket cylinder by wrapping the sheet around the blanket cylinder and attaching the opposite ends of the sheet to the blanket cylinder in an axially extending gap in the blanket cylinder. The adjoining opposite ends of the sheet define a gap extending axially along the length of the printing blanket. The gap moves through the nip between the blanket cylinder and the plate cylinder, and also moves through the nip between the blanket cylinder and the impression cylinder, each time the blanket cylinder rotates.

When the leading and trailing edges of the gap in the printing blanket move through the nip between the blanket cylinder and an adjacent plate or impression cylinder, pressure between the blanket cylinder and the adjacent cylinder is relieved and established, respectively. The repeated relieving and establishing of pressure at the gap causes vibrations and shock loads in the cylinder and throughout the printing press. Such vibrations and shock loads detrimentally affect print quality. For example, at the time that the gap relieves and establishes pressure at the nip between the blanket cylinder and the plate cylinder, printing may be taking place on the web or sheet moving through the nip between the blanket cylinder and the impression cylinder. Any movement of the blanket cylinder or the printing blanket caused by the relieving and establishing of pressure at that time can smear the image which is transferred from the printing blanket to the web. Likewise, when the gap in the printing blanket moves through the nip between the blanket cylinder and the impression cylinder, an image being picked up from the printing plate by the printing blanket at the other nip can be smeared. The vibrations and shock load caused by the gap in the printing blanket has resulted in an undesirably low limit to the speed at which printing presses can be run while maintaining acceptable print quality.

Conventional printing plates are also manufactured as flat sheets and are mounted in the same way as the printing blankets. The printing cylinders to which the printing plates are mounted also have axially extending gaps in which opposite ends of the printing plates are secured. The adjoining opposite ends of the printing plate also define a gap extending axially along the length of the printing plate.

Smearing of the ink pattern is also promoted by slippage between the surfaces at the nip where the ink pattern is transferred to the printing blanket. Thus, if the speed of the printing blanket surface is either greater or less than the speed of the surface transferring the ink pattern to the printing blanket the surfaces will slip relative to each other which smears the ink pattern.

Several devices have attempted to solve the vibration problem. One such device is disclosed in U.S. Pat. No. 4,913,048. This device attempts to solve the problem by replacing the conventional flat printing plate with a printing plate that is tubular. With this arrangement the tubular printing plate is axially inserted onto and removed from the plate cylinder rather than wrapped around the printing cylinder. With such a device the printing cylinder must be recalibrated both rotationally and axially to take into account the gap extending axially along the length of the printing blanket so that the entire image is printed. Additionally, in a multicolor printing press the printing plate must also be recalibrated relative to the other printing and blanket cylinders. This calibration process takes considerable downtime during which the printing press is not operating. Moreover, since the printing blanket in this device has an axially extending gap vibrations are not eliminated because pressure variations continue to occur both at the nip between the printing cylinder and the blanket cylinder and at the nip between the blanket cylinder and the impression cylinder.

The device disclosed in European Pat. No. 0 225 509 A2 also seeks to reduce vibrations in printing presses. It is similar to the device disclosed in U.S. Pat. No. 4,913,048 except that the printing blanket is also tubular in shape. However, with this arrangement, like the device disclosed in U.S. Pat. No. 4,913,048, every time a printing form needs to be removed, one end of the printing cylinder must be decoupled from the frame. This requires not only removing a portion of the frame, but also extensive adjustments associated with recoupling and realigning the printing cylinder to the frame. This becomes a time consuming task especially since printing forms and plates are generally removed more frequently than printing blankets and they need to be readjusted every time they are removed.

Moreover, this device requires considerable modification to the conventional printing press because not only does the frame and blanket cylinder need to be redesigned, but the printing cylinder also needs to be redesigned. Therefore, this device is undesirable because it causes considerable downtime in the printing press and requires expensive modifications to conventional printing presses.

OBJECTS AND SUMMARY OF THE INVENTION

It is an object of this invention to provide an offset lithographic printing press including a gap-free printing blanket which reduces vibrations occurring at high operating speeds in a simple, cost efficient way which avoids considerable downtime in the printing press and involves minimal modification to conventional press design.

An advantage of the present invention is that a gapless printing blanket provides smooth and vibration free rolling engagement between the printing blanket and the printing plate and between the printing blanket and an impression cylinder. This promotes transfer of inked images to the web or sheet without smearing. A further advantage of the present invention is that it obtains these results without having to make significant modifications to the conventional printing press and without having to make complicated readjustments and realignments to the plate cylinder every time a printing plate is changed.

The present invention provides an offset lithographic printing press, comprising: a plate cylinder having an axially extending gap therein; a blanket cylinder engagable with the plate cylinder; and a removable printing blanket mounted on the blanket cylinder, the printing blanket being tubular in shape and having a continuous outer circumferential gap-free surface.

Additionally, the present invention provides a frame which supports the plate and blanket cylinders. A portion of the frame adjacent one axial end of the blanket cylinder is adapted to be moved out of the way in order to provide access to one end of the blanket cylinder to enable a printing blanket to be moved axially onto and off of the blanket cylinder. The tubular printing blanket may be moved axially through the opening in the frame created by movement of the frame portion out of the way.

The present invention also provides means for expanding the printing blanket so that it can be placed on the blanket cylinder, e.g., the cylinder interior may have air pressure applied thereto and passages for communicating air to the outer peripheral surface of the blanket cylinder. Air pressure applied to the interior of the blanket cylinder is thus communicated to the interior of the printing blanket to expand same as it is inserted onto the blanket cylinder. After the printing blanket is located on the outer periphery of the blanket cylinder, the air pressure may be removed. The printing blanket then contracts around the blanket cylinder and tightly engages and grips the cylinder periphery throughout the axial extent of the printing blanket and throughout the circumferential extent of the inner surface of the printing blanket. This pressure relationship between the printing blanket and the blanket cylinder can be relieved by again applying air pressure to the interior of the blanket cylinder to enable the printing blanket to be manually moved off the cylinder.

The present invention further provides that the printing blanket is at least partially formed of a compressible material which is compressed by the plate cylinder at a nip formed between the printing cylinder and the blanket cylinder. By compressing the compressible material at the nip, the outer surface of the printing blanket has a surface speed which is substantially the same at locations immediately before the nip, at the nip, and immediately after the nip. This prevents slippage between the surfaces of the printing plate and printing blanket before, at, and after the nip to prevent smearing of the ink pattern.

The tubular printing blanket has a cylindrical outer layer of incompressible material and a cylindrical layer of compressible material on an inner layer of rigid material. The outer layer of the printing blanket is deflectable to compress the compressible layer of the printing blanket. The compressible layer of the printing blanket contains a plurality of voids which are relatively large before the compressible layer is compressed and which are relatively small in the portion of the compressible layer which is compressed by deflection of the outer layer of the printing blanket at the nip.

The rigid inner layer of material is stressed in tension by the blanket cylinder to provide a tight pressure relationship between the printing blanket and the blanket cylinder. This pressure relationship fixes the printing blanket on the blanket cylinder so that there is no relative movement therebetween during operation of the press. The press includes means for effecting radial expansion of the tubular printing blanket while on the blanket cylinder to relieve the pressure relationship between the printing blanket and blanket cylinder. When the pressure relationship is relieved, the printing blanket may be manually moved axially off of the blanket cylinder. Also, the printing blanket must be expanded radially (tensioned radially) outwardly in order to permit movement of the printing blanket axially onto the blanket cylinder. The press is also provided with structure for performing this function.

Other advantages and characteristics of the present invention will become apparent in view of the following detailed description taken in connection with the accompanying drawings.

DETAILED DESCRIPTION

Figure 1:
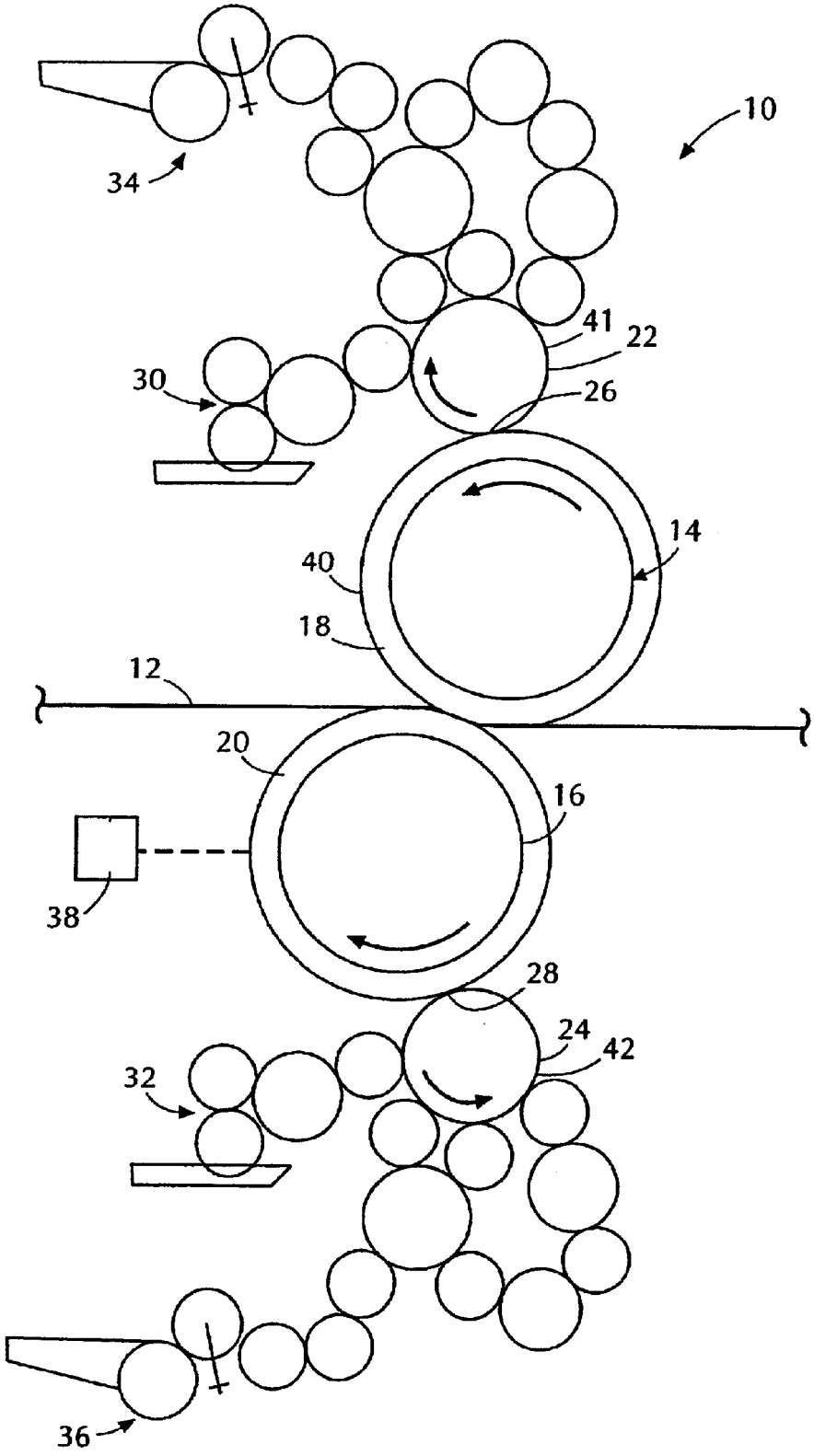
FIG. 1 is a schematic illustration of an offset printing press.

The present invention may be embodied in a number of different constructions and applied to a number of different offset printing presses. By way of example, the drawings illustrate the present invention as applied to an offset lithographic printing press 10. The lithographic printing press 10 prints on opposite sides of a sheet material web 12, as shown in FIG. 1. The lithographic printing press 10 includes identical upper and lower blanket cylinders 14 and 16. Printing blankets 18 and 20 are mounted on the blanket cylinders 14 and 16 and apply ink patterns to opposite sides of the web 12. Upper and lower plate cylinders 22 and 24 support printing plates 41 and 42 which are disposed in rolling engagement with the printing blankets 18 and 20 at nips 26 and 28. Ink patterns are applied to the printing blankets 18 and 20 by the printing plates 41 and 42 on the plate cylinders 22 and 24 at the nips 26 and 28. These ink patterns are, in turn, applied to opposite sides of the web 12 by the printing blankets 18 and 20.

The printing press 10 includes upper and lower dampener assemblies 30 and 32 which apply dampening solution to the printing plates 41 and 42 on the plate cylinders 22 and 24. In addition, upper and lower inker assemblies 34 and 36 apply ink to the printing plates 41 and 42 on the plate cylinders 22 and 24. A drive assembly, indicated schematically at 38 in FIG. 1, is operable to rotate the blanket cylinders 14 and 16 and plate cylinders 22 and 24 at the same surface speed. The drive assembly 38 also supplies power to drive the dampener assemblies 30 and 32 and inker assemblies 34 and 36. It is contemplated that the printing press 10 could have a construction other than the illustrated construction. For example, the printing press 10 could be constructed to print on only one side of the web 12.

The printing blanket 18 has a hollow tubular construction. It is fixedly connected with the blanket cylinder 14 and rotates with the blanket cylinder 14 under the influence of the drive assembly 38. However, the tubular printing blanket 18 can be removed from the blanket cylinder 14 and replaced, as will be discussed below.

Furthermore, the printing blanket 18 has a cylindrical outer surface 40 which is continuous and free of gaps to promote smooth rolling engagement with the cylindrical outer surface of the printing plate 41 on the plate cylinder 22. The absence of gaps in the smooth cylindrical outer surface 40 of the printing blanket 18 eliminates bumps or vibrations as compared to having a gap which rolls into and out of engagement with the surface of the printing plate 41 on the plate cylinder 22. The elimination of bumps or vibrations tends to minimize smearing of the ink pattern as it is applied to the surface 40 of the printing blanket 18 by the printing plate 41 on the plate cylinder 22.

By providing the printing blanket 18 with a cylindrical outer surface 40 which is continuous and free of gaps, the diameter of the printing blanket 18 and the diameter of the blanket cylinder 14 can be minimized. Thus, an ink pattern can be applied to the surface 40 of the printing blanket 18 throughout the entire area of the surface 40. The ink pattern can extend across an area where a gap was previously formed in the surface of known blanket cylinders.

In addition, by providing the printing blanket 18 with a cylindrical outer surface 40 which is continuous and free of gaps, the amount of the web 12 which is wasted during a printing operation is reduced. In one specific embodiment of the invention, approximately 0.25 inches of the web is saved on each revolution of the blanket cylinder 14.

Figure 2:
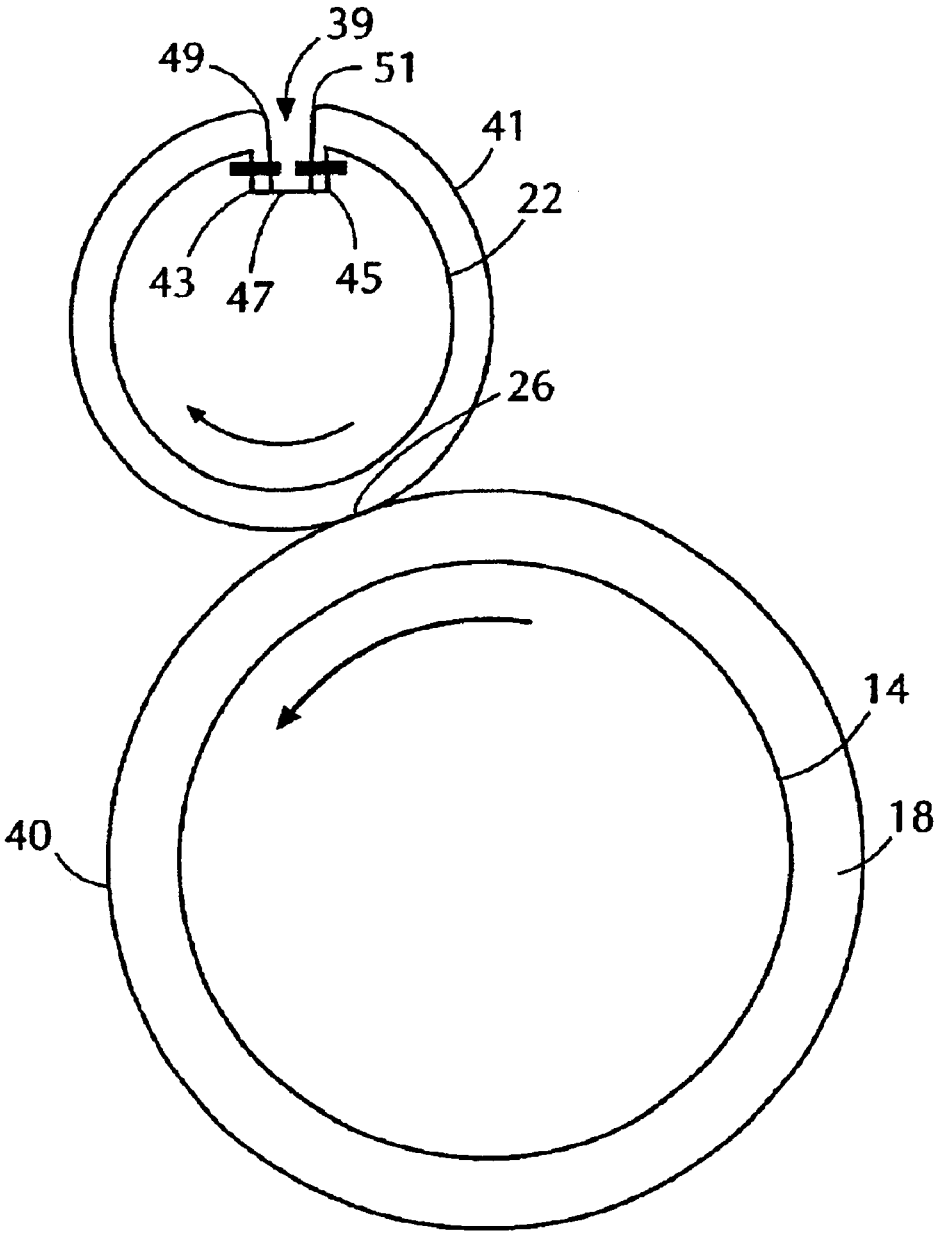
FIG. 2 is a schematic illustration of a portion of the printing press illustrated in FIG. 1 showing a gapless tubular printing blanket disposed on a blanket cylinder in rolling engagement with a conventional printing plate and disposed on a conventional printing cylinder.

The preferred embodiment of the present invention is shown in FIG. 2, wherein the gapless tubular printing blanket 18 is disposed on the blanket cylinder 14 in rolling engagement with the printing plate 41 disposed on the plate cylinder 22. The printing plate 41 is adapted to be wrapped around the circumferential surface of the printing cylinder 22 and is secured in a gap 39 extending axially along the length of the printing cylinder 22. The gap 39 is defined by side walls 43 and 45 and a base 47. The printing plate 41 is flat and rectangular shaped having opposite ends 49 and 51 which are respectively fastened to the side walls 43 and 45. The ends 49 and 51 are adjustably fastened to the walls 43 and 45 by specialized screws or similar means. The gap 39 is adapted so that ends 49 and 51 can be precisely aligned both horizontally and vertically on the walls 43 and 45 before they are securely mounted. Other means may be used for securing the printing plate 41 in the gap 39. Additionally, the printing plate 42 is secured to the printing cylinder 24 in the same manner.

Figure 3:
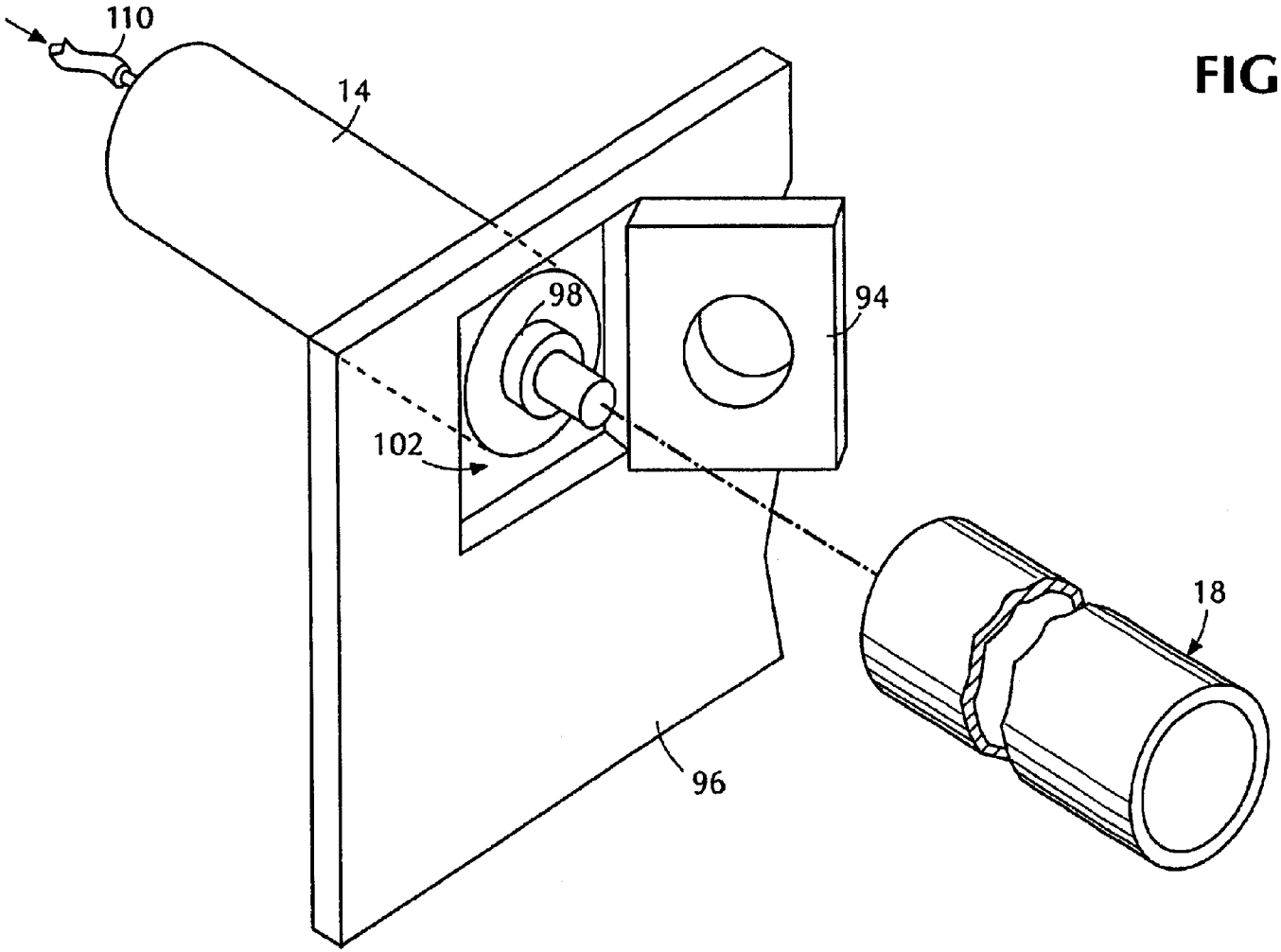
FIG. 3 is a schematic illustration of the manner in which a portion of a frame of the printing press of FIG. 1 is movable to an open position to provide access to the blanket cylinder.

The printing blanket 18 can be axially mounted on and removed from the blanket cylinder 14 while the blanket cylinder remains in the printing press 10, as shown in FIG. 3. Access is provided to one axial end portion of the blanket cylinder 14 by preferably having a portion 94 of a side frame 96 of the printing press 10 movable between open and closed positions. When side frame portion 94 is in the closed position, it engages a bearing assembly 98 to support one end of the blanket cylinder 14.

When it is desired to remove a printing blanket 18 from the blanket cylinder 14 and replace it with another printing blanket, the portion 94 of the frame is moved from the closed position to the open position. This provides an opening 102 in the frame 96 through which the printing blanket 18 can be moved. In the embodiment of the invention illustrated schematically in FIG. 3, the movable portion 94 of the frame is mounted for pivotal movement about a vertical axis by a hinge (not shown) which interconnects the movable portion 94 and the frame 96. However, the movable portion 94 could be mounted in a different manner if desired.

When the movable portion 94 is pivoted to the open position of FIG. 3, the end of the blanket cylinder 14 opposite from the side frame 96 supports the entire weight of the blanket cylinder. To enable the blanket cylinder to be supported at only one end, a relatively strong bearing arrangement may be mounted in the opposite side frame or a counterpoise may be connected with the end of the blanket cylinder 14 opposite from the side frame 96.

When the movable portion 94 of the side frame 96 has been moved to the open position of FIG. 3, a printing blanket 18 can be manually moved axially off of the blanket cylinder 14 through the opening 102. A new printing blanket 18 is then axially aligned with the blanket cylinder 14 and slid onto the blanket cylinder. Once the new printing blanket 18 has been slid onto the blanket cylinder 14, the movable portion 94 of the side frame is moved back to its closed position in engagement with the bearing 98 to support the blanket cylinder for rotation about its horizontal central axis.

An alternative to having a removable portion of the frame for removal of the printing blanket is to completely remove the blanket cylinder from the press by a crane and replace the printing blanket at a location away from the press. Alternatively, the blanket cylinder could be hinged at one end in such a manner that it could be pivoted into a position at which the printing blanket could be removed from the blanket cylinder.

Figure 5:
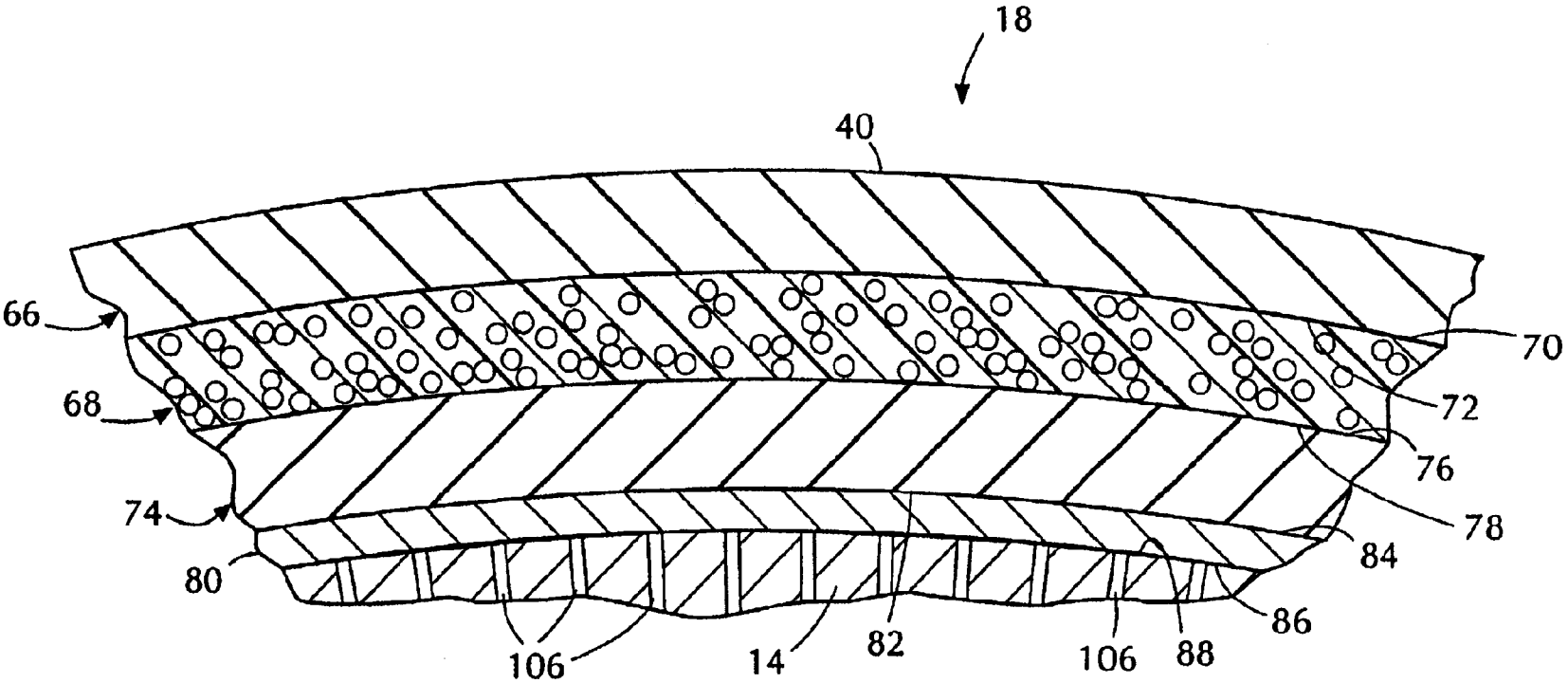
FIG. 5 is an enlarged fragmentary sectional view of a portion of a printing blanket constructed in accordance with the present invention and mounted in the printing press of FIG. 1.

The printing blanket 18 and the blanket cylinder 14 have a metal-to-metal interference fit between the cylindrical metal sleeve 80 on the inside of the printing blanket 18 and the outer circumference of the metal blanket cylinder 14, as shown in FIG. 5. Thus, the inner side surface 86 of the cylindrical sleeve 80 has a uniform diameter which is slightly less in its relaxed state than the uniform diameter of the cylindrical surface 88 on the outside of the metal blanket cylinder 14. The extent of interference required between the sleeve 80 and blanket cylinder 14 must be sufficient to enable the printing blanket 18 to firmly grip the blanket cylinder outer circumference during operation of the press 10 so that the printing blanket does not slip relative to the blanket cylinder.

In order to manually slide the printing blanket 18 onto the blanket cylinder 14, the printing blanket 18 is resiliently expanded by fluid pressure. Thus, the blanket cylinder 14 is provided with radially extending passages 106, as shown in FIG. 5. The radially extending passages 106 are evenly spaced apart in a large number of radial planes which extend through the blanket cylinder 14 throughout the length of the blanket cylinder.

The blanket cylinder 14 is hollow and is connected with a source of fluid (air) under pressure by a conduit 110, as shown in FIG. 3. The air pressure conducted through the conduit 110 to the interior of the blanket cylinder 14 flows outwardly through the passages 106, shown in FIG. 5, and presses against the inner side surface 86 of the metal sleeve 80. The air pressure causes the metal sleeve 80 to resiliently expand circumferentially an amount sufficient to enable the printing blanket 18 to be manually slid onto the blanket cylinder 14 with a minimum of difficulty.

Once the printing blanket 18 has been positioned axially on the blanket cylinder 14, the interior of the blanket cylinder 14 is vented to the atmosphere. The sleeve 80 and the printing blanket 18 then contract to securely grip the outer surface 88 of the blanket cylinder 14. The sleeve 80 is then maintained in tension by the blanket cylinder 14. In one specific embodiment of the printing blanket 18, an air pressure of approximately 60 psi is necessary to effect the expansion of the sleeve 80. Of course, the magnitude of the air pressure required to effect the necessary resilient expansion of the sleeve 80 may vary as a function of the radial thickness of the sleeve 80, the material from which the sleeve is made and the extent of interference between the sleeve and the blanket cylinder 14.

The printing blanket 18 is manually slid onto the blanket cylinder 14 from an axial end thereof. In order to provide access to one end of the blanket cylinder 14, preferably a portion of the frame adjacent one axial end of the blanket cylinder may be moved out of the way. The tubular printing blanket 18 is inserted axially through the frame 96 onto the blanket cylinder 14 which is aligned with the printing blanket.

To facilitate insertion of the printing blanket 18 onto the cylinder 14, the cylinder interior may have an air pressure applied thereto. Passages 106 to the outer peripheral surface 88 of the blanket cylinder 14 communicate with the interior of the blanket cylinder, as shown in FIG. 5. Air pressure applied to the interior of the blanket cylinder 14 is thus communicated to the interior of the printing blanket 18 to expand same as it is inserted onto the blanket cylinder. After the printing blanket 18 is located on the outer periphery of the blanket cylinder 14, the air pressure may be removed. The printing blanket 18 then contracts around the blanket cylinder 14 and tightly engages and grips the blanket cylinder periphery throughout the axial extent of the printing blanket and throughout the circumferential extent of the inner surface 86 of the printing blanket 18.

Figure 6:
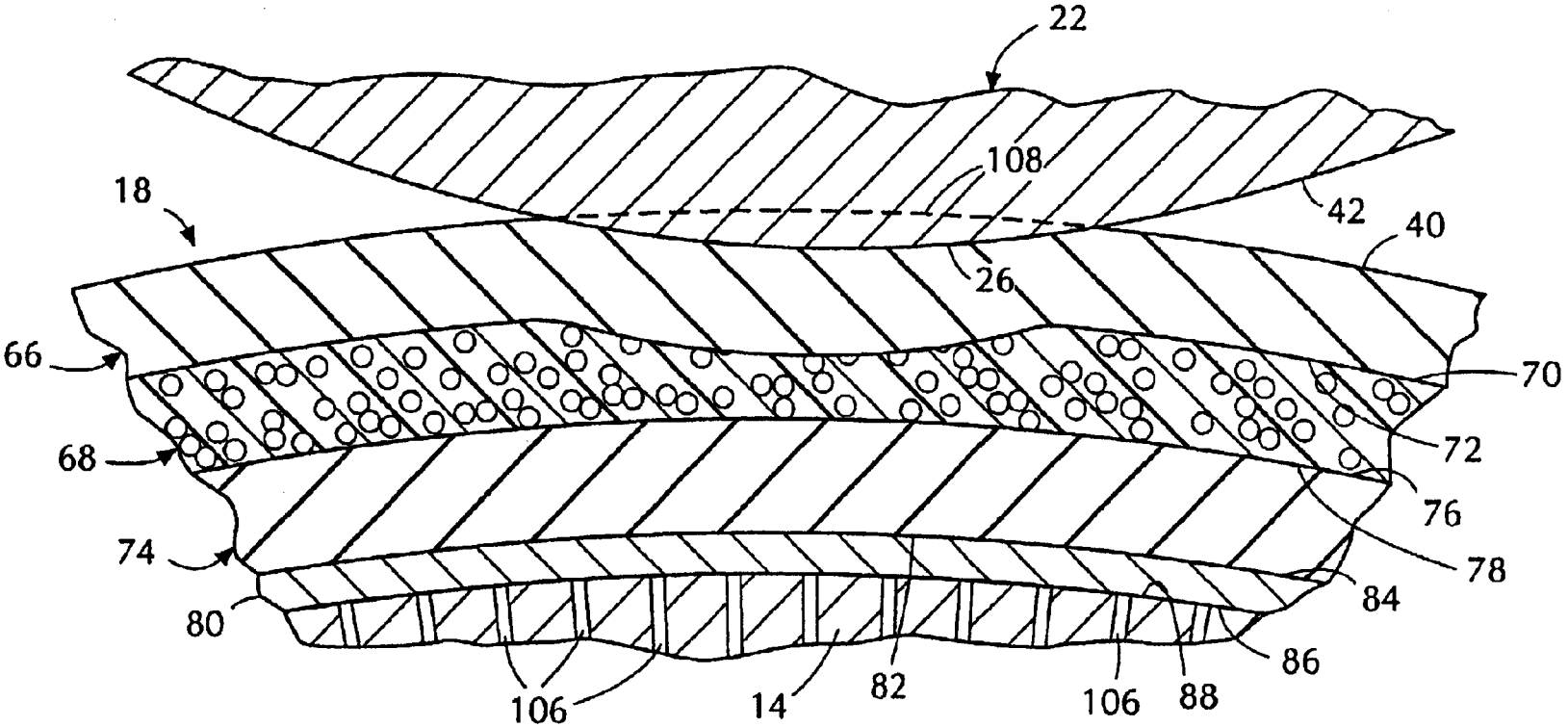
FIG. 6 is an enlarged schematic illustration of the manner in which an incompressible outer layer of the blanket cylinder of FIG. 5 is deflected to compress a compressible inner layer at a nip between the blanket cylinder and a plate cylinder.

Preferably, the printing blanket 18 is at least partially formed of a compressible material. The compressible material may be formed as a gapless layer. When a force is applied to the compressible material of the printing blanket 18, the volume of the compressible material decreases. The material of the printing blanket 18 is compressed at the nip 26 by the rigid plate cylinder 22. Since the printing blanket 18 is at least partially formed of compressible material, the printing blanket yields radially inwardly without any radially outward deformation of the printing blanket at the nip 26, as shown in FIG. 6.

Since the printing blanket 18 is at least partially formed of a compressible material, the surface speed of the printing blanket is the same at all locations immediately before the nip 26, at the nip, and immediately after the nip between the blanket cylinder 18 and plate cylinder 22. Since the speed of points on the surface 40 of the printing blanket is the same at opposite sides of the nip 26 and at the center of the nip, there is no slippage between the surface 40 of the blanket cylinder and the surface of the printing plate 41 on the plate cylinder 22 at the nip 26. This prevents smearing of the ink pattern as it is applied to the printing blanket 18 by the printing plate 41 on the plate cylinder 22.

Figure 4:
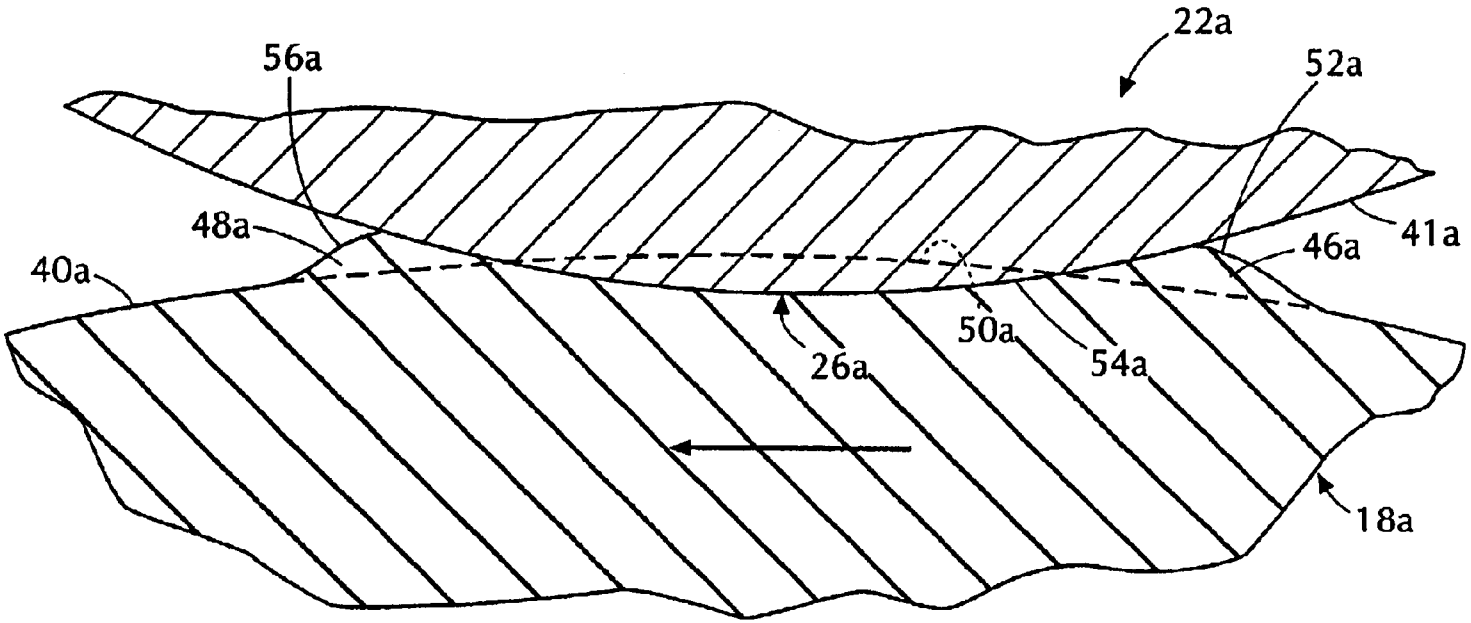
FIG. 4 PRIOR ART
FIG. 4 is an enlarged schematic illustration of the manner in which a prior art printing blanket formed of an incompressible material is deformed at a nip between plate and blanket cylinders of the printing press of FIG. 1.

If the printing blanket 18 was formed of an incompressible material, as is a printing blanket 18*a* of FIG. 4, the incompressible material of the printing blanket would be deflected radially outwardly and circumferentially sidewardly at a nip 26*a* by pressure applied against the printing blanket 18*a* by a printing plate 41*a* on the plate cylinder 22*a* in the manner shown schematically in FIG. 4. The incompressible material of the printing blanket 18*a* which is displaced by deflecting the printing blanket at the nip 26*a*, forms bulges 46*a* and 48*a* on opposite sides of the nip 26*a*.

The bulges 46*a* and 48*a*, shown in FIG. 4, are formed because the volume of incompressible material forming the printing blanket 18*a* remains constant even though the incompressible material is deflected at the nip 26*a*. Therefore, the volume of material which is displaced by the printing plate 41*a* on the plate cylinder 22*a* is equal to the volume of material in the bulges 46*a* and 48*a*. The volume of material displaced by the printing plate 41*a* on the plate cylinder 22*a* is the same as the volume of material contained in overlapping portions of the spatial envelopes of the cylindrical outer side surface 40*a* of the printing blanket 18*a* and the cylindrical outer side surface of the printing plate 41*a* on the plate 22*a*. This volume of material is contained between the arcuate plane indicated by the dashed line 50*a* in FIG. 4 and the arcuate outer side surface of the printing plate 41*a* on the plate cylinder 22*a* and extends throughout the axial extent of the plate and blanket cylinders.

The speed of a point on the surface of the incompressible material of the printing blanket 18*a* varies as the point moves from one side of the nip 26*a* to the opposite side of the nip. Thus, as the material in the bulge 46*a* moves into the nip 26*a*, the material accelerates and the surface speed of the material increases. As the incompressible material leaves the nip 26*a* and moves into the bulge 48*a*, the material decelerates and the surface speed decreases.

At a given instant, a point 52*a* on the surface of the bulge 46*a* is moving slower than a point 54*a* at the center of the nip 26*a*. Similarly, a point 56*a* on the surface of the bulge 48*a* is moving slower than the point 54*a* at the center of the nip 26*a*. The magnitude of the difference in the surface speed of the incompressible material of the printing blanket 18*a* at the bulges 46*a* and 48*a* and the center of the nip 26*a* is a function of the extent of deflection of the incompressible material of the blanket cylinder at the nip. As the surface speed of the incompressible blanket cylinder material moving through the nip 26*a*, shown in FIG. 4, first increases and then decreases, ink pattern smearing slippage occurs between the outer side surface 40*a* of the printing blanket 18*a* and the outer side surface of the printing plate 41*a* on the plate 22*a*. Thus, at locations remote from the nip 26*a*, the surface 40*a* of the printing blanket 18*a* and the circumferential surface the printing plate 41*a* on the plate cylinder 22*a* have the same speed. However, as a point on the surface 40*a* moves onto the bulge 46*a* during rotation of the printing blanket 18*a* in a counterclockwise direction (as viewed in FIG. 4), the speed of the point on the surface of the printing blanket decreases to a surface speed which is less than the surface speed of the printing plate 41*a* on the plate cylinder 22*a*.

As a point on the surface 40*a* of the printing blanket 18*a* moves from the bulge 46*a* toward the center of the nip 26*a*, the speed of the point increases to a speed which is greater than the surface speed of the printing plate 41*a* on the plate cylinder 22*a*. As the printing blanket 18*a* continues to rotate, the speed of movement of the point decreases as it moves from the center of the nip 26*a* to a point on the bulge 48*a*. The speed of a point on the surface of the bulge 48*a* is less than the surface speed of the printing plate 41*a* on the plate cylinder 22*a*.

It should be understood that the printing blanket 18 of FIG. 1 does not have the same construction as the printing blanket 18*a* of FIG. 4. Thus, the printing blanket 18*a* of FIG. 4 is formed of an incompressible material. The printing blanket 18 of FIG. 1 is at least partially formed of a compressible material. Therefore, the printing blanket 18 of FIG. 1 will not deform in the manner illustrated schematically in FIG. 4.

Although the tubular printing blanket 18 could have many different constructions, in the specific embodiment of the invention illustrated herein, the printing blanket 18 has a laminated construction. Thus, the printing blanket 18 includes a cylindrical outer layer 66 upon which the smooth continuous outer side surface 40 of the printing blanket is disposed, as shown in FIG. 5. The cylindrical outer layer 66 is formed of a resiliently deflectable and incompressible polymeric material, such as natural or artificial rubber.

An intermediate cylindrical layer 68 is disposed radially inwardly of the outer layer 66, as shown in FIG. 5. The intermediate layer 68 has a cylindrical outer side surface 70 which is fixedly secured to a cylindrical inner side surface 72 of the outer layer 66. In accordance with one of the features of the invention, the cylindrical intermediate layer 68 is formed of a resiliently compressible polymeric material, such as a natural or artificial rubber.

A cylindrical third layer 74 is disposed radially inwardly of the intermediate layer 68. The third layer 74 has a cylindrical outer side surface 76 which engages and is fixedly connected to a cylindrical inner side surface 78 of the intermediate layer 68. Although the third layer 74 may be formed of a different material, in the illustrated embodiment of the invention, the third layer 74 is formed of the same incompressible material as the outer layer 66.

The third layer 74 is fixedly secured to a hollow rigid metal inner layer comprising a mounting sleeve 80 which is fixedly connected to the blanket cylinder 14. A cylindrical inner side surface 82 of the third layer 74 is fixedly secured to a cylindrical outer side surface 84 of the sleeve 80. A cylindrical inner side surface 86 of the sleeve 80 engages a cylindrical outer side surface 88 of the cylinder 14. The sleeve 80, in the illustrated embodiment of the invention, is formed of nickel and is releasably fixedly connected with the blanket cylinder 14 to enable the entire printing blanket 18 to be slid axially onto and/or off of the rigid metal blanket cylinder 14. This construction enables the printing blanket 18 to be replaced after a period of use.

The sleeve 80 is stressed in tension by the blanket cylinder 14 to provide a tight pressure relationship between the printing blanket 18 and the blanket cylinder 14. This pressure relationship fixes the printing blanket 18 on the blanket cylinder 14 so that there is no relative movement therebetween during operation of the press. The press includes means for effecting radial expansion of the tubular printing blanket while on the blanket cylinder to relieve the pressure relationship between the printing blanket 18 and blanket cylinder 14, as described above. When the pressure relationship is relieved, the printing blanket 18 may be manually moved axially off of the blanket cylinder 14. Also, the sleeve 80 must be expanded radially or tensioned radially outwardly in order to move the printing blanket 18 onto the blanket cylinder 14.

Although the tubular printing blanket 18 has been described herein as having first and third layers 66 and 74 formed of an incompressible material and an intermediate layer 68 formed of a compressible material, the tubular printing blanket 18 could have a greater or lesser number of layers if desired. For example, another layer of compressible material could be provided. This additional layer of compressible material could be placed immediately adjacent to the intermediate layer 68 and formed with a stiffness which is either greater or less than the stiffness of the intermediate layer 68.

When the plate cylinder 22 and blanket cylinder 14 are spaced apart from each other prior to a printing operation, that is, when the press 10 is in a thrown-off position, the tubular printing blanket 18 is in the unrestrained or initial position of FIG. 5. At this time, each of the coaxial layers 66, 68 and 74 has a cylindrical configuration.

When a printing operation is to be undertaken, the blanket 18 and a printing plate 41 on the plate cylinder 22 are moved into engagement with each other in the manner shown in FIG. 6. As the blanket 18 and printing plate 41 on the plate cylinder 22 engage each other, the outer layer 66 of the blanket is resiliently deflected radially inwardly at the nip 26. The distance which the outer layer 66 is deflected radially inwardly is determined by the amount by which the initial spatial envelope of the cylindrical outer side surface 40 of the printing blanket 18 overlaps the cylindrical spatial envelope of the outer side surface of the printing plate 41 on the plate cylinder 22. Thus, the outer side surface 40 of the outer layer 66 is deflected radially inwardly from the position indicated in dashed lines at 108 in FIG. 6 to the position shown in solid lines.

The cylindrical outer layer 66 is formed of an incompressible material. When the outer layer 66 is deflected radially inwardly, the volume which is enclosed by the surface 40 of the outer layer is decreased by the volume enclosed in the space between the dashed line 108 and the side surface 40 of the deflected outer layer 66. Since the outer layer 66 is formed of an incompressible material, the volume of the outer layer itself does not change when the outer layer is resiliently deflected by the plate cylinder 22 in the manner shown in FIG. 6. In accordance with one of the features of the invention, the intermediate layer 68 of the printing blanket 18 is formed of a compressible material. When the outer layer 66 is deflected by the printing plate 41 on the plate cylinder 22, the intermediate layer 68 is resiliently compressed. Thus, the volume of space occupied by the intermediate layer 68 decreases from an initial or uncompressed volume, shown in FIG. 5, to a second or compressed volume, shown in FIG. 6, which is less than the initial volume.

Since the intermediate layer 68 is compressed by the printing plate 41 on the plate cylinder 22, the outer layer 66 deflects without bulging radially outwardly at opposite sides of the nip 26, in a manner similar to that shown in FIG. 4 for the printing blanket 18*a*. Thus, when the outer layer 66 of the printing blanket 18 is deflected by the printing plate 41 on the plate cylinder 22, bulges corresponding to the bulges 46*a* and 48*a* of FIG. 4 are not formed in the outer layer 66. This is because the intermediate layer 68 is compressed by an amount sufficient to accommodate the deflected material of the outer layer 66.

As a result of the compression of the intermediate layer 68 and the lack of bulges in the outer layer 66, the speed at locations on the surface 40 of the outer layer immediately before the nip 26, at the center of the nip, and immediately after the nip are substantially the same as the speed of the surface of the printing plate 41 on the plate cylinder 22. Therefore, there is smooth rolling engagement between the printing blanket 18 and printing plate 41 on the plate cylinder 22 at the nip 26 without slippage between the surfaces 40 and 42. Of course, this promotes the transfer of an ink pattern from the printing plate 41 on the plate cylinder 22 to the printing blanket 18 without smearing the pattern.

The compressible second or intermediate layer 68 is formed from a resilient foam which contains voids. When the outer layer 66 is deflected and the intermediate layer 68 is compressed, shown in FIG. 6, the voids are reduced in size or eliminated. As the voids in the polymeric foam forming the intermediate layer 68 are compressed, the volume of the compressible material forming the intermediate layer 68 is reduced.

Prior to deflection of the outer layer 66 of the printing blanket 18 and compression of the intermediate layer 68, shown in FIG. 3, the tubular printing blanket 18 and blanket cylinder 14 occupy a relatively large first volume which is enclosed by the continuous cylindrical outer surface 40 of the outer layer 66. At this time, the cylindrical intermediate layer 68 contains relatively large voids and occupies a relatively large first or initial volume. Upon engagement of the printing blanket 18 and printing plate 41 on the plate cylinder 22, as shown in FIG. 6, the outer layer 66 of the printing blanket 18 is deflected radially inwardly. Deflection of the tubular outer layer 66 results in the printing blanket 18 occupying a volume which is less than its original or undeflected volume. However; the total volume of the outer layer 66 remains constant and the outer layer does not bulge outwardly adjacent to opposite sides of the nip 26 in the manner shown in FIG. 4 for the blanket 14*a*.

As the outer layer 66 is deflected, the intermediate layer 68 of the printing blanket 18 is compressed to a volume which is less than the initial volume of the intermediate layer 68. The difference between the initial volume of the intermediate layer 68, shown in FIG. 5, and the compressed volume of the second layer, shown in FIG. 6, is equal to the volume between the dashed line 108 in FIG. 6 and the outer side surface 40 of the outer layer 66. Therefore, the reduction in volume of the space occupied by the printing blanket 18 is accommodated by compressing the intermediate layer 68 and the only deflection of the outer layer 66 is in a radially inward direction.

Figure 7:
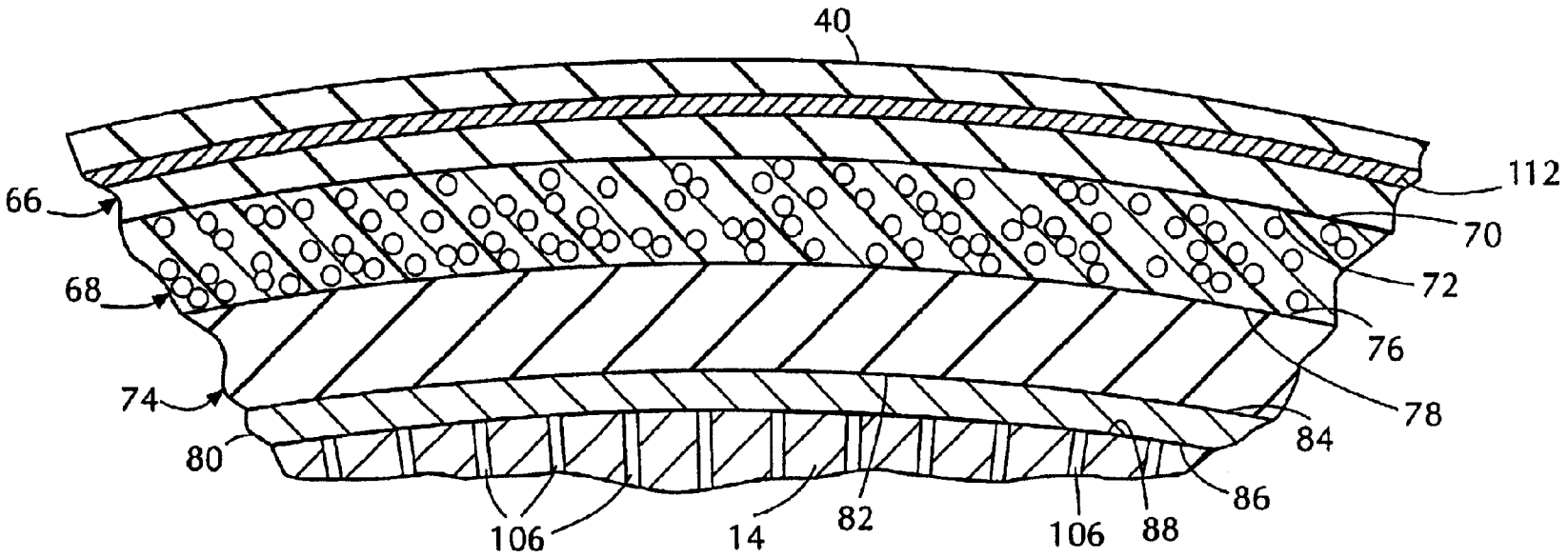
FIG. 7 is an enlarged fragmentary sectional view of a portion of another printing blanket constructed in accordance with present invention which includes an inextendable material.
Figure 8:
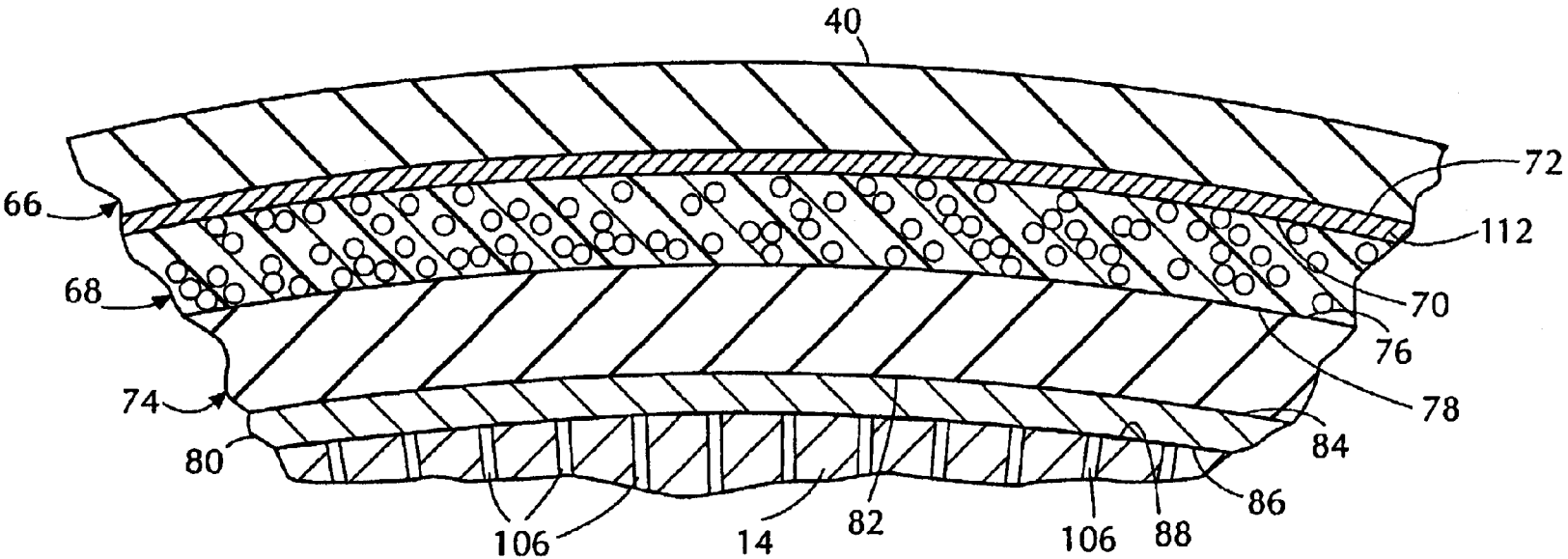
FIG. 8 is an enlarged fragmentary sectional view of a portion of another printing blanket constructed in accordance with present invention which includes an inextendable material.
Figure 9:
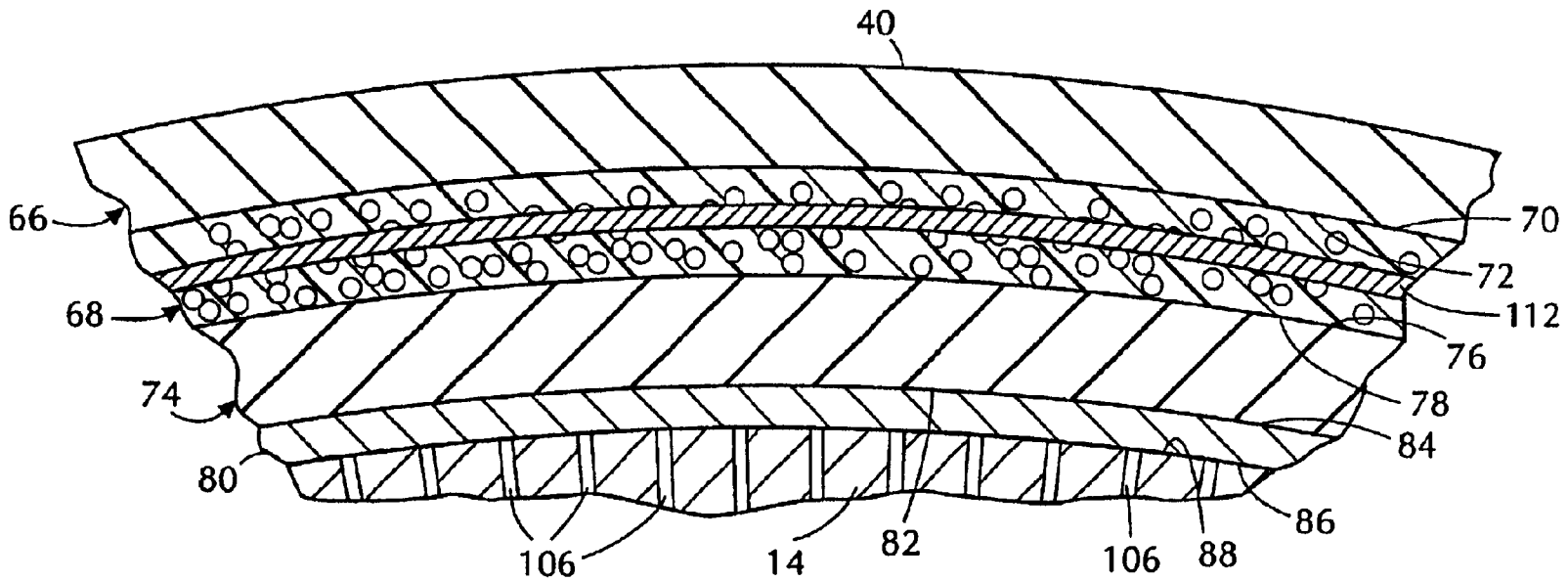
FIG. 9 is an enlarged fragmentary sectional view of a portion of another printing blanket constructed in accordance with present invention which includes an inextendable material.
Figure 10:
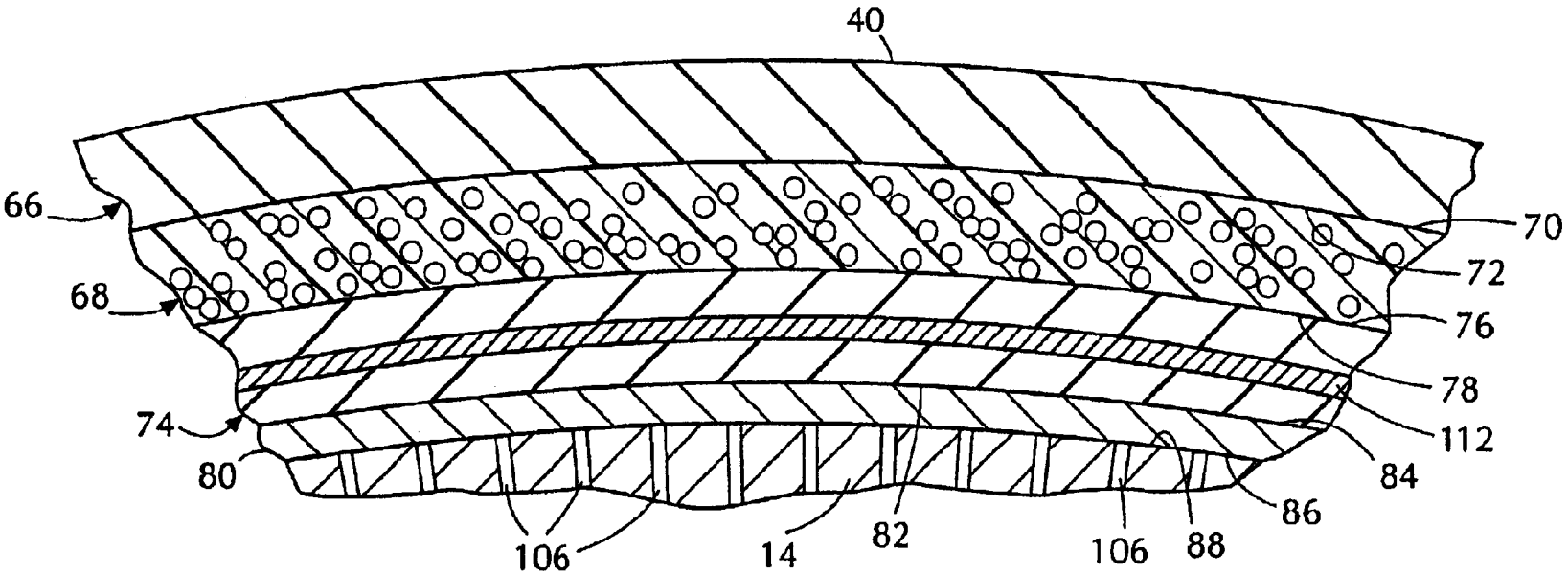
FIG. 10 is an enlarged fragmentary sectional view of a portion of another printing blanket constructed in accordance with present invention which includes an inextendable material.

It is contemplated that the printing blanket 18 could have a construction which is different than the specific construction illustrated in FIGS. 5 and 6. For example, a deflectable fabric or inextendable material could be provided between or in each of the layers 66, 68 and 74. For example, FIGS. 7 and 8 show an inextendable layer 112 in the outer layer 66 and between the layers 66, 68, respectively. FIGS. 9 and 10 show an inextendable layer 112 in the intermediate layer 68 and between the layers 68 and 80, respectively. The number of layers could be either increased or decreased. Although it is preferred to form the compressible intermediate layer 68 from a polymeric foam of uniform stiffness, the second layer could be formed with cylindrical inner and outer sections of void-containing foam having different stiffnesses. The compressible intermediate layer 68 could also be formed of a material other than foam, for example, a resiliently deflectable mesh or fabric.

Although the construction of only the printing blanket 18 is shown in FIGS. 5 and 6, the blanket 20 has the same construction as the printing blanket 18. Thus, the printing blanket 20 cooperates with the printing plate 42 on plate cylinder 24 at the nip 28 in the same manner that the printing blanket 18 cooperates with the printing plate 41 on the plate cylinder 22 at the nip 26.

What is claimed is:

1. An offset lithographic printing press comprising:

a) a first and second sidewall;

b) a plate cylinder;

c) a printing plate adapted to be wrapped around the surface of the plate cylinder, the printing plate having opposite ends;

d) a blanket cylinder having passages extending to an outer surface of the blanket cylinder;

e) a removable printing blanket mounted axially over the blanket cylinder, the printing blanket being tubular in shape;

f) a source of pressurized fluid coupled to the blanket cylinder, the source of fluid applying fluid to the blanket cylinder and through the passages to expand the removable printing blanket during installation and removal of the removable printing blanket;

g) said first sidewall having a movable portion to provide an opening in the first sidewall to enable the printing blanket to be slideably removed from the blanket cylinder when the portion of said the first sidewall is in the open position; and h) the removable printing blanket comprising a rigid cylindrical inner layer; an outer printing layer for transferring an ink pattern to a web; and an intermediate compressible layer between said inner and outer layers; wherein the removable printing blanket has an outer circumferential surface and is radially expandable so as to enable the blanket to be axially mounted onto the blanket cylinder of the offset printing press.

2. The offset lithographic printing press as recited in claim 1 further comprising a layer of inextendable material in the printing blanket.

3. The offset lithographic printing press as recited in claim 1 further comprising an inextendable material disposed between the intermediate layer and outer layer of the printing blanket.

4. The offset lithographic printing press as recited in claim 1 further comprising an inextendable material disposed in the intermediate layer of the printing blanket.

5. The offset lithographic printing press as recited in claim 1 wherein the plate cylinder has an axially extending gap therein, and the opposite ends of the printing plate are mountable within the axially extending gap.

6. The offset lithographic printing press as recited in claim 5 further comprising a layer of inextendable material in the printing blanket.

7. The offset lithographic printing press as recited in claim 5 further comprising an inextendable material disposed between the intermediate layer and outer layer of the printing blanket.

8. The offset lithographic printing press as recited in claim 5 further comprising an inextendable material disposed in the intermediate layer of the printing blanket.

* * * * *